US006006454A

United States Patent [19]

Sitzler, Sr.

[11] Patent Number: 6,006,454

[45] **Date of Patent: *Dec. 28, 1999**

[54] SOFT CLEAT FOR ATHLETIC SHOES

[76] Inventor: Edward R. Sitzler, Sr., 8214 St. Andrews Village Dr., Louisville, Ky. 40241

[ * ] Notice: This patent issued on a continued prosecution application filed under 37 CFR 1.53(d), and is subject to the twenty year patent term provisions of 35 U.S.C. 154(a)(2).

[21] Appl. No.: 09/044,941

[22] Filed: Mar. 20, 1998

[51] Int. Cl.[6] ..... A43C 15/02

[52] U.S. Cl. ..... 36/127; 36/134; 36/67 D

[58] Field of Search ..... 36/67 D, 134, 36/65, 127

[56] References Cited

U.S. PATENT DOCUMENTS

| | | | |
|---|---|---|---|
| D. 388,949 | 1/1998 | Savoie | D2/962 |
| 3,583,082 | 6/1971 | Jordan, Jr. | 36/59 |
| 4,107,858 | 8/1978 | Bowerman et al. | 36/134 |
| 4,146,979 | 4/1979 | Fabbrie | 36/67 D |
| 4,193,216 | 3/1980 | Ueda | 36/67 D |
| 4,240,215 | 12/1980 | Broussard | 37/67 D |
| 4,306,360 | 12/1981 | Hagger | 36/59 R |
| 4,330,950 | 5/1982 | Reddien | 36/127 |
| 4,392,312 | 7/1983 | Crowley et al. | 36/67 R |
| 4,466,205 | 8/1984 | Corbari | 36/67 A |
| 4,561,197 | 12/1985 | Misevich | 36/127 |
| 4,587,748 | 5/1986 | Collins | 36/127 |
| 4,689,901 | 9/1987 | Ihlenburg | 36/126 |
| 4,706,394 | 11/1987 | Regula | 36/67 D |
| 4,723,366 | 2/1988 | Hagger | 36/134 |
| 4,777,738 | 10/1988 | Giese et al. | 36/32 R |
| 4,783,913 | 11/1988 | Aoyama | 36/134 |
| 4,837,949 | 6/1989 | Dufour | 36/127 |
| 4,875,300 | 10/1989 | Kazz | 36/134 |
| 4,885,851 | 12/1989 | Peterson | 36/127 |
| 5,029,405 | 7/1991 | DeHaitre | 36/134 |
| 5,367,793 | 11/1994 | Deacon et al. | 36/127 |
| 5,524,367 | 6/1996 | Ferreira et al. | 36/134 |
| 5,782,017 | 7/1998 | Ortscheid . | |
| 5,794,367 | 8/1998 | Carroll . | |

FOREIGN PATENT DOCUMENTS

| | | |
|---|---|---|
| 524861 | 1/1993 | European Pat. Off. . |
| 1121080 | 7/1956 | France . |
| 2020358 | 7/1970 | France . |
| 2529027 | 1/1977 | Germany . |

*Primary Examiner*—Ted Kavanaugh
*Attorney, Agent, or Firm*—Maurice L. Miller, Jr.

[57] ABSTRACT

An athletic shoe cleat constructed of suitably wear resistent, yet soft, flexible, resilient material such as polyurethane is disclosed. The cleat can be removably attachable to a ground engageable portion of the shoe, such as a sole or a heel, and can be used as part of a group forming any number of arrays of such cleats for the shoe. The cleat can also be formed integrally with the sole and heel of a shoe. Common features of these cleats include a plurality of at least partially cone shaped teeth formed in a closed circle on the shoe. In the removably attachable form, the cleat employs a threaded fastener which projects through a central circular opening in a disc-like base portion and threads into the shoe. The fastener can have an enlarged flat head with radially projecting shoulder which bears against an annular part of the base portion radially inwardly of the teeth to operatively secure the cleat to the shoe. The shape of the teeth permits the cleat to exhibit excellent holding characteristics while not lifting dirt out of depressions formed by the bearing weight of the cleat on soft, moist or closely cropped grass bearing ground.

14 Claims, 2 Drawing Sheets

SOFT CLEAT FOR ATHLETIC SHOES

BACKGROUND OF THE INVENTION

This invention relates broadly to a cleat for an athletic shoe, such as a golf shoe, which may be removably secured to a ground engageable heel and/or sole of the shoe or may be integrally formed on and with the heel and/or sole. More specifically, the invention relates to a cleat constructed of soft, wear resistent, flexible, resilient material, such as polyurethane, which includes a plurality of at least partially cone shaped teeth disposed in a closed circle around an outer peripheral portion of a disc shaped base.

Broadly speaking, generally disc shaped cleats which are removably secured to a ground engageable portion of a shoe have long been known and used in the prior art. See, for example, U.S. Pat. No. 5,367,793 issued to E. I. Deacon et al. on Nov. 29, 1994. The cleat of Deacon is of interest in that it includes a disc with a plurality of raised, arc shaped ribs arrayed in an open circle about on broad surface of the disc such that there are gaps between adjacent ribs. The other broad surface of the disc is dished and contains a projecting threaded stud for being secured to the sole and/or heel of a shoe. Both the dish shaped disc and the ribs are constructed of relatively rigid, non-deformable material.

Replaceable cleats containing a single, relatively rigid cone shaped spike have also long been known in the prior art. See, for example, U.S. Pat. No. 4,723,366 issued to L.D. Hagger on Feb. 9, 1988. Also, cleats which are integral with the sole of an athletic shoe are known in the prior art. See U.S. Pat. No. 4,107,858 issued to W. T. Bowerman et al. on Aug. 22, 1978.

All of the foregoing prior art cleats are made of relatively rigid, inelastic materials. None are made of a soft, wear resistant, flexible, resilient material. While the Deacon et al. and Bowerman et al. patents contain a plurality of raised ribs and ground engaging pins, respectively, the ribs are spaced apart from one another as are the pins. While the ribs are arrayed in a circle about a central axis, the pins are arrayed in an arc, an L-shape and a straight line, but not a circle. In no case do the ribs or pins adjoin adjacent or neighboring ribs or pins, respectively, along base portions thereof.

The cleat of my invention does not include these structural characteristics, by reason of which it will not damage golf greens and, yet, can hold well on both closely cropped golf course fairways and in the relatively high grass of roughs adjacent to golf course fairways. Moreover, the cleat of my invention does not tend to dislodge pieces or clumps of dirt from holes or depressions formed by the teeth thereof when bearing upon a golf green and when, thereafter, being removed from such a green.

SUMMARY OF THE INVENTION

It is an object of my invention to provide a relatively soft, yet suitably wear resistant, flexible, resilient cleat for an athletic shoe, such as a golf shoe.

It is a further object of my invention to provide such a cleat which is removably attachable to and replaceable on a ground engageable heel and/or sole of an athletic shoe.

It is another object of my invention to provide a soft cleat for an athletic shoe which is an integral part of the sole and/or heel of the shoe.

It is yet another object of my invention to provide a soft cleat for an athletic shoe which includes a plurality of at least partially cone shaped interconnecting teeth which are disposed in a closed circle upon a disc shaped base.

It is still another object of my invention to provide a golf course cleat which is removably attachable to a golf shoe which employs teeth disposed in a closed circle and a head screw having a large flat head which limits the penetration of the teeth into a golf green to minimize damage to the green.

It is also an object of my invention to provide a relative soft cleat for an athletic shoe which is removably secured to a heel or sole of the shoe by means of a relatively hard fastener, the combination of which resists accidental loosening of the fastener and the cleat from the shoe.

Briefly, in accordance with my invention, there is provided a cleat for attachment to a ground engageable surface of a shoe comprising a flexible, resilient disc. The disc includes a broad base portion having a first broad surface for placement against a ground engageable surface of a shoe and a second broad surface opposite the first surface. The disc also includes a plurality of raised, at least partially cone shaped teeth successively interconnecting one another on base portions thereof, the teeth being disposed in a closed circle on and around a radially outer edge portion of the second surface. The disc is adapted for being secured to the ground engageable surface of the shoe.

These and other objects, features and advantages of the present invention will become apparent to those skilled in the art from the following detailed description and attached drawings upon which, by way of example, only the preferred embodiments of my invention are illustrated.

DESCRIPTION OF THE PREFERRED EMBODIMENT

Figure 2:
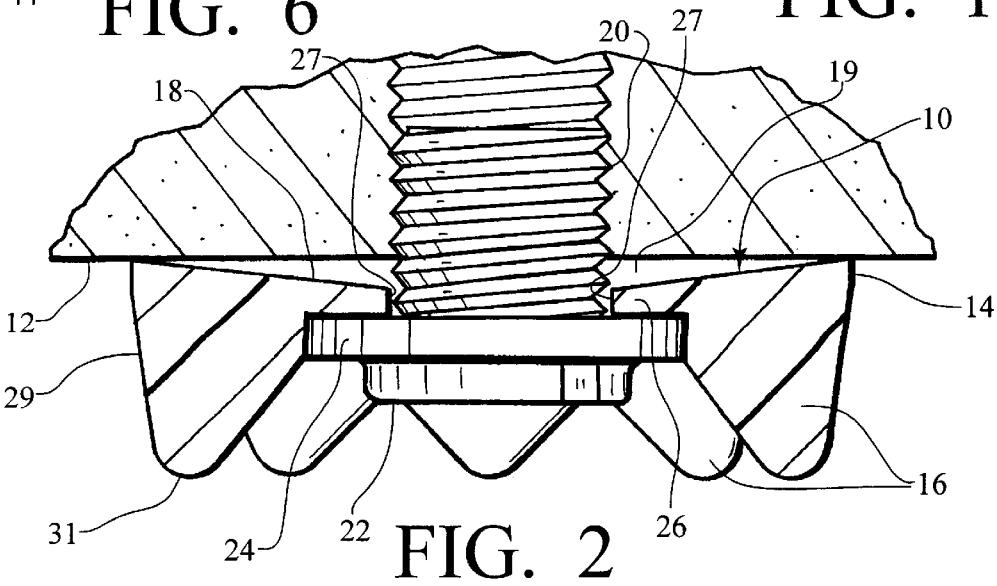
FIG. 2 shows a cross-sectional elevation view of the cleat and footwear fragment of FIGS. 1 and 1*a* as viewed along cross-section lines 2—2 of the latter mentioned figure, the cleat containing a fastener which is shown loosely securing the cleat to the footwear fragment.
Figure 3:
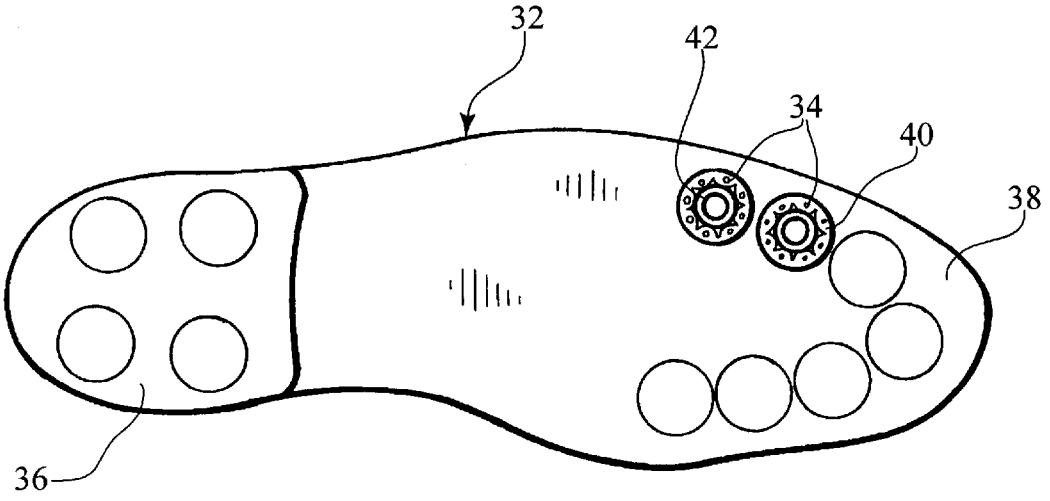
FIG. 3 shows a bottom plan view of an array of cleats secured to the sole and heel of a golf shoe, thus illustrating another important embodiment of my invention.
Figure 4:
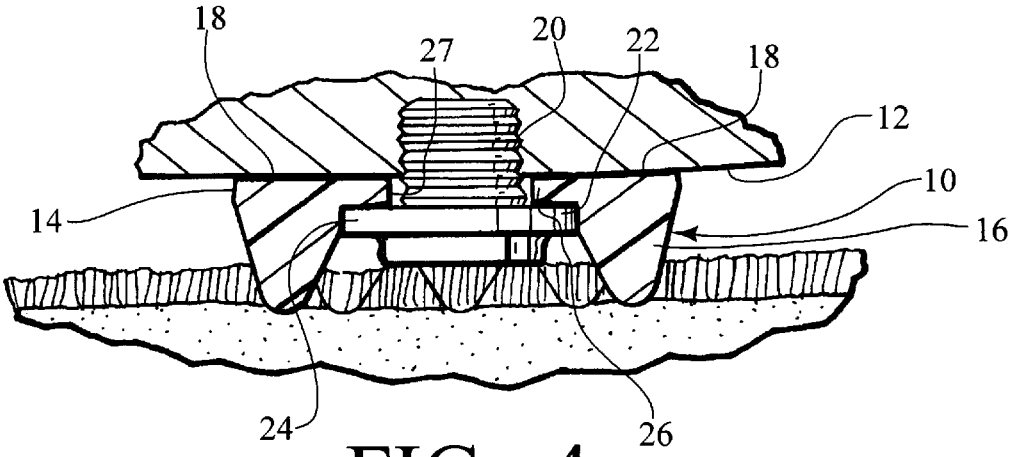
FIG. 4 shows a cross-sectional elevation view of the cleat and footwear fragment of FIGS. 1, 1*a* and 2, the same as viewed in the latter mentioned figure except as now bearing upon a closely cropped golf green, the fastener now tightly securing the cleat to the footwear fragment.
Figure 5:
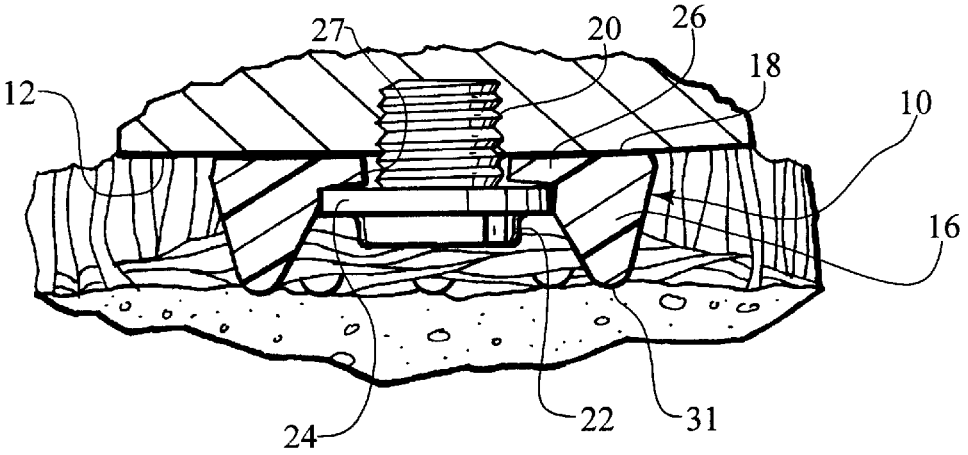
FIG. 5 shows a cross-sectional view of the cleat and footwear fragment of FIGS. 1, 1*a*, 2 and 4, the same as viewed in the latter mentioned figure except now bearing upon relatively tall grass such as encountered in a rough beside a golf course fairway.

Referring now to the drawing figures, in particular, to FIGS. 1, 1*a*, 2 and 4–5 there is shown, in a preferred embodiment of my invention, a cleat, generally designated 10, which is removably attached to a ground engageable portion 12, such as a heel or a sole of a piece of footwear as, for example, a golf shoe. The cleat 10 is constructed of a suitably wear resistent, flexible, resilient material such as, for example, polyurethane, preferably having a durometer measurement of from Shore A75 to Shore A95, inclusive. The cleat 10 comprises a disc like base portion 14 and a plurality of teeth 16 disposed on and around a radially outer edge portion of the base portion 14. A first broad surface 18 of the base portion 14 (See FIGS. 2 and 4–5) opposes the portion 12 of the shoe and may be dished or conically shaped so as to be concave and gapped as at 19 (FIG. 2 only) when the cleat 10 is in a relaxed state as, for example, when being very loosely secured to the shoe portion 12 as later more fully explained. The cleat 10 is secured to the shoe portion 12 by means of a threaded fastener 20 which, in the present example, contains a flat head 22 and a disc shaped shoulder 24 on an outer end portion of the fastener. The shoulder 24 bears upon a part 26 of the base portion 14 which is located radially inwardly of the teeth 16 around a central opening 27 of the cleat through which the fastener 20 projects. See FIGS. 2 and 4–5. Annulus 25 is formed in base portion 14, extends about teeth 16, and opening 27. Shoulder 24 is received within annulus 25, as best shown in FIGS. 2 and 4. The teeth 16 are disposed upon and rise from a second broad surface 28 of the base portion 14 (See FIG. 1) and are successively interconnected with one another along base portions thereof above the level of the second surface to thus form a closed circle around a peripheral edge portion of the base portion 14. The base portion 14 may have either a circular periphery, as in the later explained example of FIG. 3, or, as in the present example, may have a plurality of straight sides forming a polygon.

In the present example, the multi-sided base portion 14 contains eight flat sides. A series of eight separate flat sidewalls 29 extend upwardly and tilt radially inwardly from the flat sides of the base portion 14. Each of the sidewalls 29 have a V-shaped upper end with a trought or vertex 30 of each of the upper ends (See FIG. 1) being spaced apart from the second surface 28 of the base portion 14 to denote the level of interconnection between base portions of immediately adjacent pairs of the teeth 16. The teeth 16 of the present example are therefore partially cone shaped and have flat, outer sides formed by the sidewalls 29. When the fastener 20 is tightly threaded into the shoe portion 12, as in FIGS. 4–5, the dished or cone shaped surface 18 is mashed flat or flush against the shoe portion and the gap 19, as shown in FIG. 2 when the fastener 20 is loosely inserted in the shoe portion, is eliminated. This causes the teeth 16 and the flat sidewalls 29 to tilt further inwardly around the cleat than is the case when the cleat is in a relaxed state as when the fastener 20 is loose in the shoe portion as shown in FIG. 2. Note also that opposite vertically extending edges of each of the sidewalls 29 bisect immediately adjacent pairs of the teeth 16.

An important feature of cleat 10 is that it can be designed so as to have an excellent non-slip character on a closely cropped golf course without, at the same time, seriously damaging or marking the green. I have found, for example, that the flat outer surface of the head 22 should be disposed from a position level with the tips 31 of the teeth 16 to a maximum of 3/16 inch recessed from the tips 31 toward the base portion 14 when the cleat 10 is tightly secured to the shoe portion 12 by the fastener 20 as in FIGS. 4–5. I find the optimum position of the outer surface of the head 22 to be recessed about 1/8 inch from the tips 31 toward the base portion 14 when the cleat 10 is operatively secured to the shoe portion 12. I further recommend using a large diameter flat head screw for the fastener 20 having a head diameter of from about 1/4 inch to 3/4 inch with the optimum diameter being about 5/8 inch. It will also be appreciated that the head 22 can be increased in thickness so that it also takes the place of the shoulder 24 and so that it can perform the additional function of securing the cleat 10 tightly against the shoe portion 12. To guard against accidental loosening of the fastener 20, I recommend that the fastener be constructed of a relatively harder material than that of the soft cleat 10. For example, where the cleat 10 has a durometer hardness as previously specified, the fastener 20 should have a Rockwell Hardness of at least M70 or higher.

The teeth 16 should preferably project from 3/16 inch to 1/2 inch from the ground engageable portion 12 of the footwear to which the cleat 10 is secured with a projection of about 1/4 inch being optimum for holding in high grass, such as golf course roughs as well as on closely cropped golf fairways. The general cone or pyramid shape of the teeth 16 reduces or eliminates the pulling of dirt or divots out of any earth depression or hole formed by the teeth 16 as when bearing the full weight of a person on golf greens and, thereafter, removing the same. Also, it will be appreciated that the fastener 20, including the head 22 and, if used, the shoulder 24 can be integrally formed with the cleat 10 and need not necessarily be a separate and removably attachable element with respect to the cleat.

Referring now to FIG. 3, there is shown, in another important embodiment of my invention, a golf shoe, generally designated 32, having an array of cleats 34 of the present invention secured to a ground engageable heel 36 and sole 38 of the shoe 32. The array is illustrative only of one of many well known geometrical arrangements for cleats on a golf shoe. The cleats 34 may be of polygonal shape as in the previous example shown in FIGS. 1, 1*a*, 2 and 4–5. However, in the present example, while still disc shaped, the cleats 34 have a circular periphery. As in the previous example, the cleats 32 have a plurality of raised teeth 40 which are cone or pyramid shaped and which are located on and around a radially outer portion of the disc. A suitable threaded fastener 42, which may be similar to the fastener 20 of the previous example, secures the circular disc shaped cleat 34 to the shoe 32. Here, as in the previous example, it is preferable that each of the teeth 40 successively join immediately adjacent teeth on base portions thereof above the level of the disc upon which they are mounted to form a closed circle on the disc. This assures that the teeth 16 will not be too flimsy and so that the otherwise soft material of the teeth will have satisfactory strength.

Figure 1:
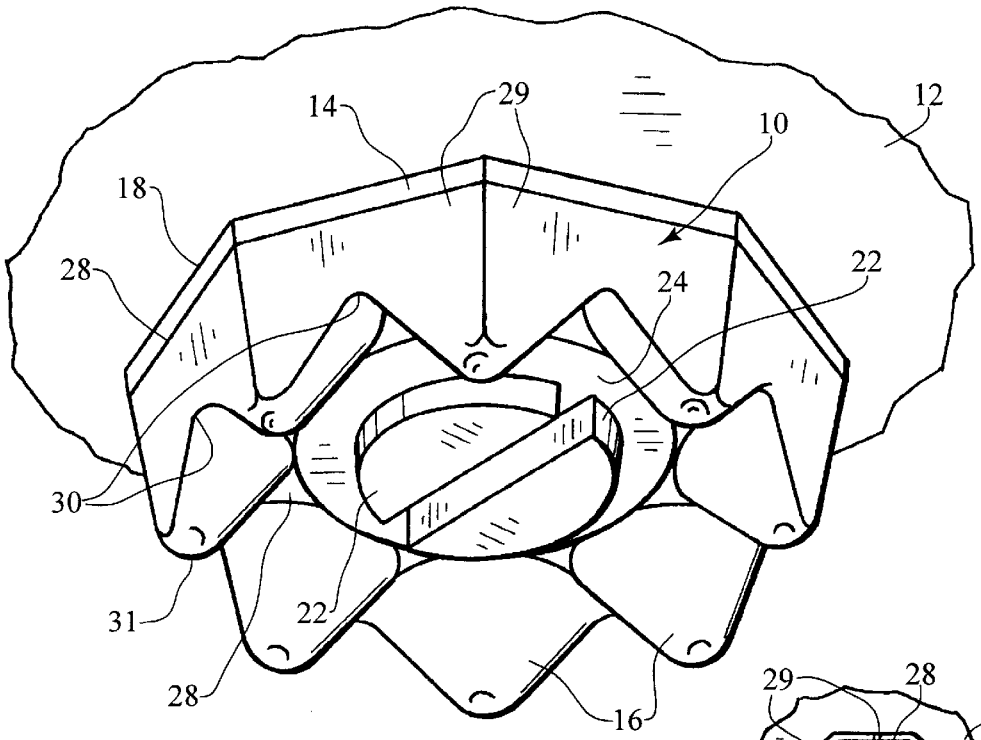
FIG. 1 shows a perspective view of a novel cleat secured to a fragment of a ground engageable portion of a piece of footwear, thus illustrating a preferred embodiment of my invention.
Figure 1A:
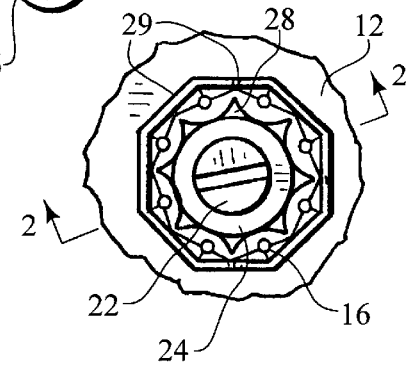
FIG. 1*a* shows a bottom plan view of the cleat and surrounding footwear fragment of FIG. 1.
Figure 6:
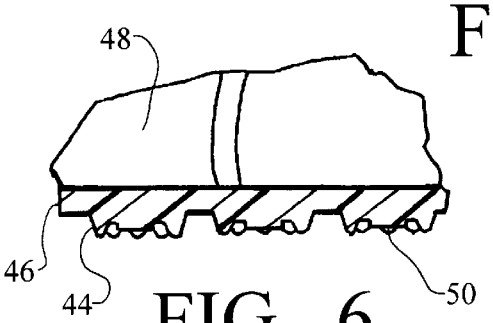
FIG. 6 shows a side elevation view of a portion of a golf shoe having a sole shown in cross-section which contain cleats similar to those of FIG. 1, 1*a*, 2 and 4–5 except that, here, the cleats are integrally formed with the sole.

Referring now to FIG. 6, there is shown, in yet another important embodiment of my invention, a series of suitable wear resistant, flexible, resilient cleats 44 which are integrally formed on the sole 46 of a sports shoe 48. In this example, each of the cleats 44 could be identical to either the cleat 10 of the first example or the cleats 34 of the second example, except that, in this case, there is no need for a threaded fastener. The cleats 44 could also be integrally formed on a heel of the same material and the heel and sole could, likewise, be integrally formed. In the present example both the cleats 44 and sole 46 would be made of a suitable molded material, i.e. a foam such as polyurethane, and would be molded together in a single operation. Since no fastener would be needed to secure the cleat 44 to the sole 46, a large diameter, raised, flat, disc shaped portion 50 would be molded in place of the head 22 and shoulder 24 of the fastener 20, for example, to perform the same function in relation to the teeth 44 as the shoulder and head perform in relation to the teeth 16 in the first example.

Although the present invention has been described with respect to specific details of certain preferred and important embodiments thereof, it is not intended that such details limit the scope and coverage of this patent otherwise than as specifically set forth in the following claims.

I claim:

1. A cleat for attachment to a ground engageable surface of a shoe comprising a flexible, resilient disk formed from a polymeric material having a first broad surface from which a plurality of frustoconical teeth extend in a closed, uninterrupted, circle on and around a radially outer edge portion of said first broad surface and successively interconnecting one another along a base portion thereof which extends to a level spaced from said broad surface, an aperture extending centrally through said first and second broad surfaces, and an annulus extending around said first broad surface whereby a fastener received within said annulus extends through said aperture for securing the cleat to a shoe.

2. The cleat of claim 1 wherein said disc contains a circular periphery.

3. The cleat of claim 1 wherein said disc contains a polygonal, multi-sided periphery having a plurality of flat outer sides.

4. The cleat of claim 3 wherein said disc contains eight flat sides and the periphery of said disc forms an octagon.

5. The cleat of claim 3 wherein the radially outer surface of said teeth forms a plurality of flat sidewalls, each of said flat sidewalls extending upwardly and radially inwardly from a different flat outer side of said base portion, opposite vertically extending edges of each of said flat sidewalls bisecting successive ones of said teeth.

6. The cleat of claim 1 wherein said disc and said teeth are constructed of soft polyurethane material having a durometer of from Shore A75 to Shore A95, inclusive.

7. The cleat of claim 1 wherein the combined height of said disc and said teeth is not less than 3/16 inch and not greater than ½ inch.

8. The cleat of claim 1 wherein each of said teeth includes a rounded tip.

9. The cleat of claim 1 wherein said disc is removably attachable to a ground engageable surface of a shoe.

10. The cleat of claim 9 further comprising a fastener having an externally threaded shank and including a head and a disc-like shoulder attached to one end of said shank, said shoulder projecting radially beyond a periphery of said shank for bearing against a central portion of said broad surface which is located radially inwardly of said teeth, said shank being adapted for disposition through the aperture formed on and along an axis of said disc and spaced radially inwardly of said teeth, said shank being threaded tightly into said ground engageable surface when in an operative condition, an outer surface of said fastener head being disposed between a level even with a tip of each of said teeth and a level which is recessed from the tip of each of said teeth toward said central portion and which is spaced above said central portion when said shank is threaded tightly into said shoe to operatively secure said disc to said shoe.

11. The cleat of claim 10 wherein a base surface of said disc is dished so as to form a conical space between said disc and said ground engageable surface of said shoe around said fastener shank when said fastener is disposed in said central opening and loosely threaded into said shoe, said base surface being mashed flush against said ground engageable surface when said fastener is tightly threaded into said shoe to operatively secure said disc to said shoe.

12. The cleat of claim 10 wherein said fastener head includes a flat outer surface.

13. The cleat of claim 12 wherein said outer surface of said head is located between the level of a tip of each of said teeth and a position which is recessed between a tip of each of said teeth and said broad surface by not more than 3/16 inch from said level when said fastener is operatively positioned relative to said disc and when said shank is tightly threaded into said shoe.

14. The cleat of claim 10 wherein said disc and teeth contain a durometer hardness of from Shore A75 to Shore A95 and said fastener contains a Rockwell Hardness of at least M70.

* * * * *